United States Patent [19]

Hoffmann

[11] 3,942,733

[45] Mar. 9, 1976

[54] DEVICE FOR REMOVING FULL BOBBINS ON OPEN-END SPINNING MACHINES

[75] Inventor: Herbert Hoffmann, Schwanewede, Germany

[73] Assignee: Fried. Krupp Gesellschaft mit beschrankter Haftung, Essen, Germany

[22] Filed: Mar. 21, 1973

[21] Appl. No.: 343,533

[30] Foreign Application Priority Data

Mar. 23, 1972 Germany ..... 2214072

[52] U.S. Cl. ..... 242/35.5 A; 57/1 R; 57/52

[51] Int. Cl.[2] ..... B65H 54/02; D01H 9/18

[58] Field of Search ..... 57/1, 34 R, 52–54; 198/33 R, 33 AA, 33 AD, 100, 282; 242/35.5 A

[56] References Cited

UNITED STATES PATENTS

| | | | |
|---|---|---|---|
| 2,295,935 | 9/1942 | Cotchett | 57/1 R |
| 2,443,855 | 6/1948 | Gibson, Jr. | 57/1 R |
| 2,570,057 | 10/1957 | Haythornthwaite | 57/52 |
| 2,648,422 | 8/1953 | Kling | 198/100 X |
| 2,670,836 | 3/1954 | Ball | 198/100 X |
| 2,911,088 | 11/1959 | Ingham, Jr. et al. | 198/33 AA |
| 3,030,761 | 4/1962 | Negishi | 57/52 |
| 3,485,338 | 12/1969 | Stirling | 198/33 AD |
| 3,678,672 | 7/1972 | Brissey et al. | 57/52 |
| 3,681,906 | 8/1972 | Burgermeister et al. | 57/52 |
| 3,721,328 | 3/1973 | Drew | 198/33 R X |
| 3,741,490 | 6/1973 | Venot | 242/35.5 A X |
| 3,791,126 | 2/1974 | Kose et al. | 57/53 |

*Primary Examiner*—John W. Huckert
*Assistant Examiner*—Charles Gorenstein
*Attorney, Agent, or Firm*—Walter Becker

[57] ABSTRACT

A device for withdrawing full bobbins prepared on open-end spinning machines with a spooling device at its lower portion, which includes conveyor means arranged below the spooling device and having associated therewith protective means for protecting the spooling device and rotating bobbins from accidental interference from the floor on which the open-end spinning machine is mounted.

1 Claim, 3 Drawing Figures

DEVICE FOR REMOVING FULL BOBBINS ON OPEN-END SPINNING MACHINES

The present invention relates to a device for removing full bobbins on open-end spinning machines with the spooling device arranged at the lower portion thereof.

In view of the very high output of open-end spinning machines, it is necessary to produce bobbins of optimum size with as large a diameter as possible and with as high a weight as possible.

It is an object of the present invention to provide a device for removing such heavy and relatively unhandy bobbins while simultaneously providing means which will protect the spooling device and the rotating bobbins against damage and will also protect the operator against injuries which might result when he should accidentally touch the rotating bobbins.

These and other objects and advantages of the invention will appear more clearly from the following specification, in connection with the accompanying drawings, in which.

Figure 1:
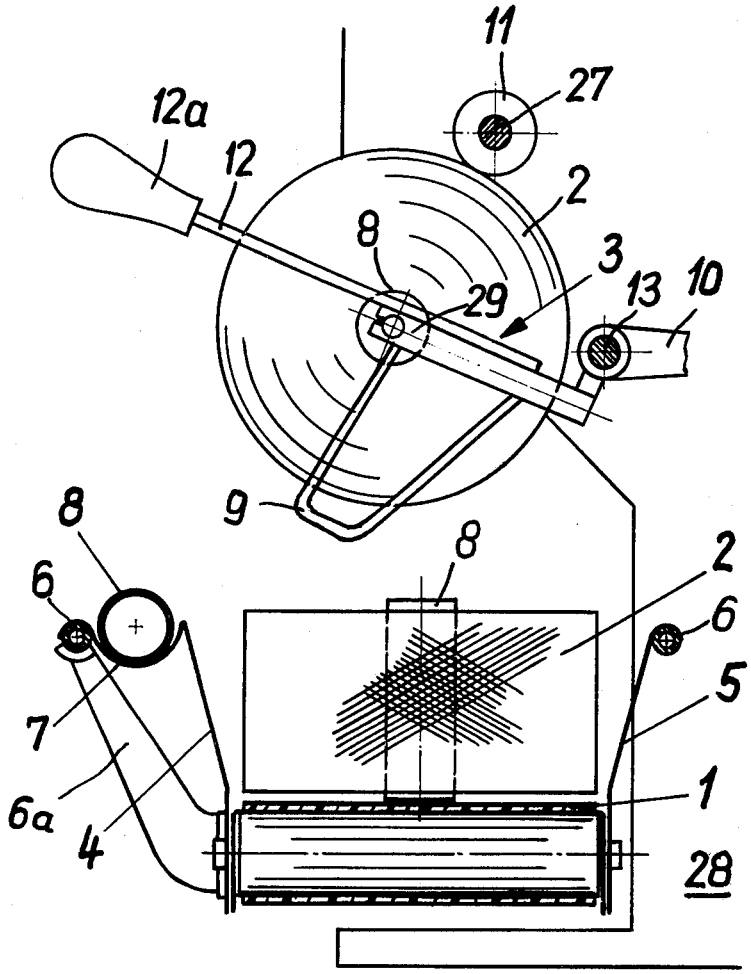
FIG. 1 is a vertical section transverse to the longitudinal extension of an open-end spinning machine between two adjacent bobbin holders, only the lower front portion of said open end spinning machine being shown.

The device according to the present invention for removing full bobbins on open-end spinning machines with the spooling device located at the lower portion thereof is characterized primarily by a conveying device which has associated therewith a protective means shielding the spooling device and the rotating bobbins against accidental contact or manipulation from the floor side.

Expediently, at the end of the conveying device there is arranged a pivotable further conveying device by means of which the full bobbins may selectively be deposited into various containers or onto further conveying devices.

Referring now to the drawings in detail, below the spooling device there is arranged a conveyor belt 1 onto which the full bobbins 2 drop after their release from the bobbin frame 3. The conveyor belt 1 conveys the bobbins 2 to a collecting station at the head side of the machine or to other transporting devices. In a manner not illustrated, at the end of the conveyor belt 1 there is expediently arranged a pivotable depositing belt by means of which the full bobbins may selectively be deposited into various containers or onto other conveying devices.

The bobbins 2 are, by laterally arranged guiding plates 4 and 5, guided on the conveyor belt 1. Simultaneously, the guiding plates 4 and 5 serve for catching the dropping down full bobbins 2 after they have been released from the bobbin frame 3.

The front guiding plate 4 is at the same time so designed that at its top side it comprises a collecting trough 7 in which empty sleeves or tubes 8 are contained so that they will be available in the vicinity of the bobbin frame 3 in case a manual exchange of the full bobbins is necessary.

In addition thereto, the guiding plate 4 together with a pipe 6 resting on supports **6*a*** forms a protective device which prevents injuries to the operators and damage to the spooling device with its rotating bobbins by accidental contact or manipulation, especially from the floor side.

On that side of the bobbin frame 3 which is located upstream of the conveying direction there is provided a tilting frame 9 by means of which any bobbins which might be standing in upright position on the conveyor belt will during their removal automatically be tilted into their flat position so that they will not come into contact with the bobbins rotating in the spooling device.

Figure 2:
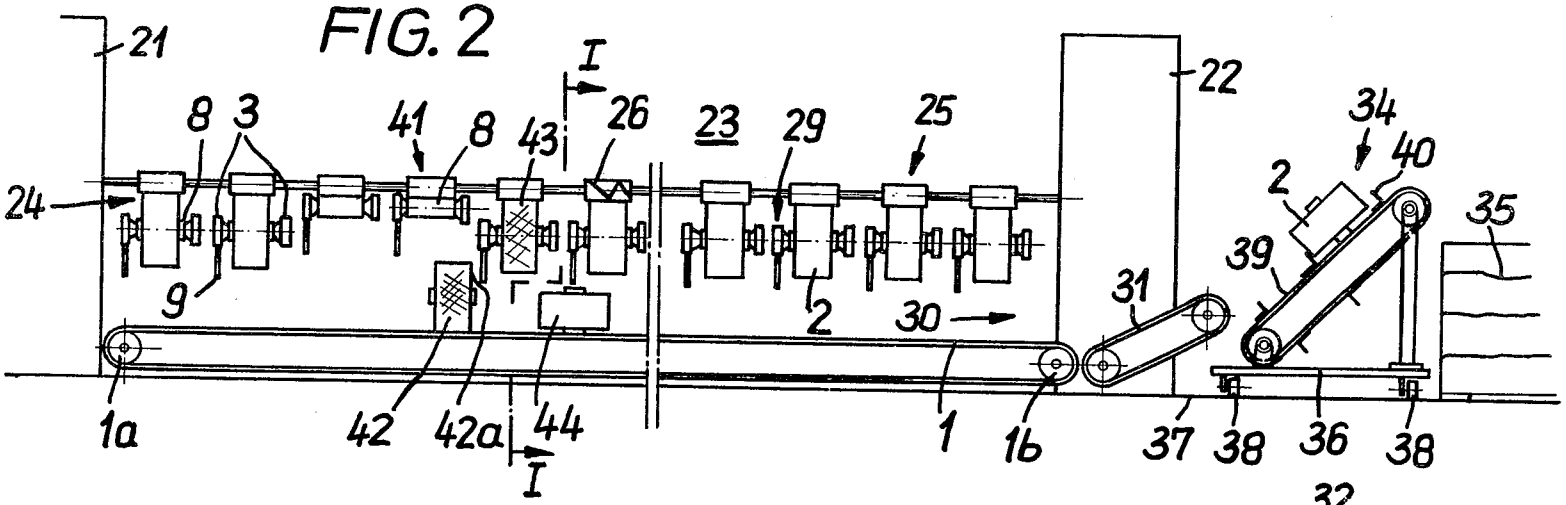
FIG. 2 is a front view of FIG. 1 in which the guiding plates of the conveyor belt built into the spinning machine, and the protective device are removed.
Figure 3:
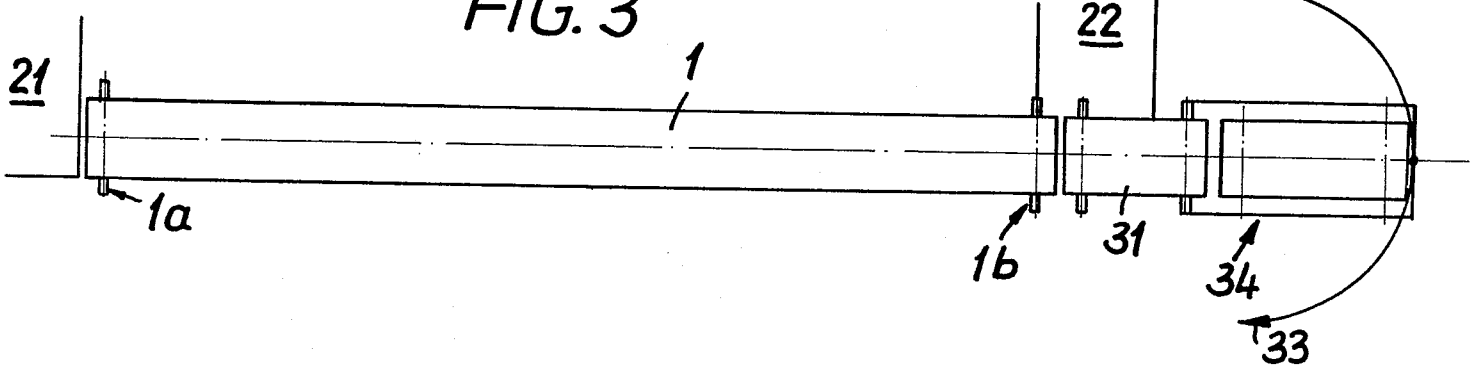
FIG. 3 is a diagrammatic top view of the conveyor belt with the conveyor device following the same.

According to FIG. 2, between the heads 21 and 22 at the end of the device there are provided driving units and electric control devices as well as the spinning field 23 without the pertaining spinning devices. Below the spinning field 23 there is provided a winding device 24. Below the winding device 24 and structurally pertaining to the open-end spinning machine is a conveyor belt 1 of any standard type.

The winding device 24 comprises a plurality of individual winding stations 25. Each winding station 25 has associated Therewith a traversing and driving shaft 11 with a traversing groove 26. The traversing and driving shaft 11 together with the driving shafts of the remaining winding stations is non-rotatably arranged on the driving shaft 27, which in its turn is rotatably journaled in the heads 21 and 22 and is driven from there. The U-shaped bobbin frame 3 receives the empty sleeve 8 upon which the bobbin is wound while the traversing and driving shaft 11 drives directly upon the circumference first of the empty sleeve 8 and then of the bobbin 2 being formed. The bobbin frame 3 is vertically pivotally mounted on the horizontal shaft 13, which in its turn is arranged on the holding means 10, said holding means forming a non-movable part of the machine frame 28. The bobbin frame is, in a manner known per se, by a non-illustrated spring device loaded in the direction of rotation upwardly in such a way that the bobbin 2 is yieldably pressed against the non-yieldably mounted driving shaft 11, and during the winding up is with increasing diameter pivoted downwardly.

The so-called bobbin lever 12 is arranged on one arm 29 of the bobbin frame 3. This arm 29 is in a non-illustrated manner laterally pivotable outwardly (in FIG. 1 in the direction perpendicular to the drawing plane) in order to detach a complete or full bobbin 2 from the bobbin frame 3 or to cause the full bobbin 2 to drop out of the frame 3. The tilting of the arm 29 is effected by means of the bobbin lever 12 which comprises a handle **12*a*.**

The full bobbin 2 released from the bobbin frame 3 drops automatically due to its weight onto the conveyor belt 1 which comprises the two reversing rollers **1*a* and 1*b*. By means of the conveyor belt 1, the bobbins 2 are conveyed in the direction of the arrow 30. At the reversing roller 1*b*, the full bobbins 2 are, preferably through the short intermediate conveyor belt 31 arranged at an incline, conveyed to a conveyor 34 which is horizontally pivotable in conformity with arrows 32 and 33. This conveyor 34 drops the complete bobbins 2, for instance, into a container 35. The conveyor 34 comprises a frame 36 which, for purposes of carrying out the horizontal tilting movement is, by means of rollers 38, mounted on the floor 37. Arranged on frame 36 with a considerable ascent is a conveyor belt 39** which for purposes of grasping the full bobbins 2 is equipped with followers 40. The pivoting adjustment of the conveyor 34 may with regard to the conveyor belt 1 or the short intermediate conveyor belt 31 be carried out manually while by pivoting the conveyor device 34, the full bobbins 2 are either uniformly distributed into a container 35 or are successively deposited in a plurality of containers arranged adjacent to each other.

According to FIG. 1, the bobbins 2 when being conveyed by the conveyor belt 1 are passed through the guiding plates 4 and 5 arranged laterally of the belt 1. At the same time, the guiding plates 4 and 5 serve for catching the dropping complete bobbin 2 after the latter has been disengaged from the bobbin frame in the manner described above.

The front guiding plate 4 is so designed that at the upper end thereof there is provided a collecting trough 7 in which empty bobbins 8 are received so that they will be at hand when exchanging the full bobbin 2 for an empty bobbin 8 and are located in the vicinity of the bobbin frame 3.

In addition thereto, the guiding plate 4 together with the tube resting on the support 6*a* forms a protective device which will prevent damage to the winding device 24 with the rotating bobbins 2 as it may otherwise be caused by accidental handling operations especially from the floor side. Furthermore, the protective device also serves as protection against accidents, inasmuch as it prevents the servicing personnel or operator from coming into contact from the floor side with the winding device 24 and the rotating bobbins 2.

On that side of the bobbin frame 3 which is located opposite to the conveying direction (arrow 30 in FIG. 2) and, more specifically, on the leg 29 comprising the bobbin lever 12 there is provided a shiftover frame 9. The function of this shiftover frame will now be described in connection with FIG. 2.

There exists the possibility that bobbins 2 located in on-edge position in the bobbin frame 3 will when disengaging the bobbins from the bobbin frame also rest on edge on the conveyor belt 1 (see the full bobbin 42 which has been disengaged from bobbin station 41). This full bobbin 42 resting on edge would during its conveyance by means of the conveyor belt 1 hit the rotating bobbin 43 which is not yet filled and has not yet reached its intended thickness and will be exchanged later, so that the danger of damaging the not yet completed bobbin would exist. This danger is prevented by the shiftover lever 9. When the bobbin 42 is being withdrawn, it engages with its upper portion of the leading end face 42*a* the shiftover lever 9 and in the course of its further removal will automatically shift over into its flat position as is illustrated in connection with the full bobbin 44.

Moreover, as a rule, the bobbins 2 of the different winding stations 25 are not completed simultaneously, which fact is due to the starting of the winding at different times and also is due to the occurrence of thread breaks. Thus, the conveyor belt 1, as well as the conveyors 31 and 34 following the same expediently do not move all the time, but are expediently made effective temporarily whenever a certain number of full bobbins has been deposited onto the conveyor belt 1. It is the conveyor belt 1 when at a standstill, upon which the full bobbins 2 are sometimes deposited on edge. During the later removal or conveyance, the full bobbins 42 standing on edge will then on the respective shiftover frame automatically be placed into their flat position so that a starting of the conveyor against bobbins which turn in the bobbin frame and are built up fairly far will be avoided.

It is, of course, to be understood that the present invention is, by no means, limited to the particular showing in the drawings, but also comprises any modifications within the scope of the appended claims.

What I claim is:

1. In combination with a spooling device of an open-end spinning machine, a device for removing full bobbins, which includes; conveyor means arranged below said spooling device for receiving full bobbins therefrom, protective means arranged laterally of said conveyor means at least where the latter receives a full bobbin from said spooling device for protecting the spooling device and rotating bobbins against accidental interference, said protective means including support means and a pipe attached to said support means and having an axis generally parallel to said conveyor means, guiding plate means arranged on opposite sides of said conveyor means where the latter receives full bobbins from said spooling device, said guiding plate means converging toward said conveyor means for guiding a full bobbin released from said spooling device onto said conveyor means and centering said released bobbin thereon, said guiding plate means having an upper end formed as trough means for receiving and supporting an empty bobbin sleeve, said pipe being fixedly attached to said guiding plate means at the upper end thereof adjacent said trough means, a bobbin frame forming part of said spooling device, and a folding over member projecting downwardly (as to) toward the conveying means and extending below the lowermost portion of a full bobbin held and supported by said bobbin frame, said folding over member extending to a distance from the conveyor means which is less than the height of a full bobbin package for tilting any bobbin leaving said spooling device in approximately upright position moved by said folding over member into lying position so that its axis will be transverse to the longitudinal direction of said conveyor means and substantially parallel to said folding over member.

* * * * *